US008995621B2

(12) United States Patent
Wang et al.

(10) Patent No.: US 8,995,621 B2
(45) Date of Patent: Mar. 31, 2015

(54) COMPACT X-RAY SOURCE

(75) Inventors: Dongbing Wang, Lathrop, CA (US); Dave Reynolds, Orem, UT (US)

(73) Assignee: Moxtek, Inc., Orem, UT (US)

( * ) Notice: Subject to any disclaimer, the term of this patent is extended or adjusted under 35 U.S.C. 154(b) by 90 days.

(21) Appl. No.: 13/812,102

(22) PCT Filed: Jul. 15, 2011

(86) PCT No.: PCT/US2011/044168

§ 371 (c)(1),
(2), (4) Date: Jun. 6, 2013

(87) PCT Pub. No.: WO2012/039823

PCT Pub. Date: Mar. 29, 2012

(65) Prior Publication Data

US 2014/0294156 A1 Oct. 2, 2014

Related U.S. Application Data

(63) Continuation of application No. 12/890,325, filed on Sep. 24, 2010, now Pat. No. 8,526,574.

(60) Provisional application No. 61/420,401, filed on Dec. 7, 2010.

(51) Int. Cl.
*H05G 1/14* (2006.01)
*H05G 1/20* (2006.01)
(Continued)

(52) U.S. Cl.
CPC *H05G 1/32* (2013.01); *H01J 35/22* (2013.01); *H05G 1/20* (2013.01); *H01F 27/40* (2013.01); *H01F 27/28* (2013.01); *H05G 1/12* (2013.01); *H05G 1/265* (2013.01)
USPC ..... 378/107; 378/101; 378/105; 307/43; 363/59; 363/60; 363/61

(58) Field of Classification Search
CPC ..... H05G 1/06; H05G 1/10; H05G 1/12; H05G 1/14; H05G 1/20; H05G 1/32; H05G 1/34
USPC ..... 378/101, 102, 104, 105, 106, 107; 307/43; 363/59–61
See application file for complete search history.

(56) References Cited

U.S. PATENT DOCUMENTS 1,946,288 A 2/1934 Kearsley
2,291,948 A 8/1942 Cassen
(Continued)

FOREIGN PATENT DOCUMENTS

DE 10 30 936 5/1958
DE 44 30 623 3/1996
(Continued)

OTHER PUBLICATIONS

Chen, Xiaohua et al., "Carbon-nanotube metal-matrix composites prepared by electroless plating," Composites Science and Technology, 2000, pp. 301-306, vol. 60.
(Continued)

*Primary Examiner* — Allen C. Ho

(57) ABSTRACT

A compact x-ray source can include a circuit (10) providing reliable voltage isolation between low and high voltage sides (21, 23) of the circuit while allowing AC power transfer between the low and high voltage sides of the circuit to an x-ray tube electron emitter (43). Capacitors (11, 12) can provide the isolation between the low and high voltage sides of the circuit. The x-ray source (110) can utilize capacitors of a high voltage generator (67) to provide the voltage isolation. A compact x-ray source (110) can comprise a single transformer core (101) to transfer alternating current from two alternating current sources (104*a*, 104*b*) to an electron emitter (43) and a high voltage generator (107). A compact x-ray source (120) can comprise a high voltage sensing resistor (R1) disposed on a cylinder (41) of an x-ray tube (40).

20 Claims, 12 Drawing Sheets

(51) Int. Cl.

| | |
|---|---|
| ***H05G 1/32*** | (2006.01) |
| ***H01J 35/22*** | (2006.01) |
| ***H01F 27/40*** | (2006.01) |
| ***H01F 27/28*** | (2006.01) |
| ***H05G 1/12*** | (2006.01) |
| ***H05G 1/26*** | (2006.01) |

(56) References Cited

U.S. PATENT DOCUMENTS

| | | | |
|---|---|---|---|
| 2,316,214 | A | 4/1943 | Atlee et al. |
| 2,329,318 | A | 9/1943 | Atlee et al. |
| 2,683,223 | A | 7/1954 | Hosemann |
| 2,952,790 | A | 9/1960 | Steen |
| 3,218,559 | A | 11/1965 | Applebaum |
| 3,356,559 | A | 12/1967 | Mohn et al. |
| 3,434,062 | A | 3/1969 | Cox |
| 3,679,927 | A | 7/1972 | Kirkendall |
| 3,801,847 | A | 4/1974 | Dietz |
| 3,828,190 | A | 8/1974 | Dahlin et al. |
| 3,851,266 | A | 11/1974 | Conway |
| 3,872,287 | A | 3/1975 | Kooman |
| 3,882,339 | A | 5/1975 | Rate et al. |
| 3,894,219 | A | 7/1975 | Weigel |
| 4,007,375 | A | 2/1977 | Albert |
| 4,075,526 | A | 2/1978 | Grubis |
| 4,160,311 | A | 7/1979 | Ronde et al. |
| 4,184,097 | A | 1/1980 | Auge |
| 4,393,127 | A | 7/1983 | Greschner et al. |
| 4,400,822 | A | 8/1983 | Kuhnke et al. |
| 4,421,986 | A | 12/1983 | Friauf et al. |
| 4,463,338 | A | 7/1984 | Utner et al. |
| 4,504,895 | A | 3/1985 | Steigerwald |
| 4,521,902 | A | 6/1985 | Peugeot |
| 4,679,219 | A | 7/1987 | Ozaki |
| 4,688,241 | A | 8/1987 | Peugeot |
| 4,734,924 | A | 3/1988 | Yahata et al. |
| 4,761,804 | A | 8/1988 | Yahata |
| 4,777,642 | A | 10/1988 | Ono |
| 4,797,907 | A | 1/1989 | Anderton |
| 4,819,260 | A | 4/1989 | Haberrecker |
| 4,870,671 | A | 9/1989 | Hershyn |
| 4,891,831 | A | 1/1990 | Tanaka et al. |
| 4,969,173 | A | 11/1990 | Valkonet |
| 4,979,198 | A | 12/1990 | Malcolm et al. |
| 4,995,069 | A | 2/1991 | Tanaka |
| 5,010,562 | A | 4/1991 | Hernandez et al. |
| 5,063,324 | A | 11/1991 | Grunwald |
| 5,066,300 | A | 11/1991 | Isaacson et al. |
| 5,077,771 | A | 12/1991 | Skillicorn et al. |
| 5,077,777 | A | 12/1991 | Daly |
| 5,090,046 | A | 2/1992 | Friel |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| 5,178,140 | A | 1/1993 | Ibrahim |
| 5,187,737 | A | 2/1993 | Watanabe |
| 5,200,984 | A | 4/1993 | Laeuffer |
| 5,226,067 | A | 7/1993 | Allred et al. |
| RE34,421 | E | 10/1993 | Parker et al. |
| 5,267,294 | A | 11/1993 | Kuroda et al. |
| 5,343,112 | A | 8/1994 | Wegmann |
| 5,347,571 | A | 9/1994 | Furbee et al. |
| 5,391,958 | A | 2/1995 | Kelly |
| 5,400,385 | A | 3/1995 | Blake et al. |
| 5,422,926 | A | 6/1995 | Smith |
| 5,428,658 | A | 6/1995 | Oettinger et al. |
| 5,469,429 | A | 11/1995 | Yamazaki et al. |
| 5,469,490 | A | 11/1995 | Golden et al. |
| 5,478,266 | A | 12/1995 | Kelly |
| RE35,383 | E | 11/1996 | Miller et al. |
| 5,621,780 | A | 4/1997 | Smith et al. |
| 5,627,871 | A | 5/1997 | Wang |
| 5,631,943 | A | 5/1997 | Miles |
| 5,680,433 | A | 10/1997 | Jensen |
| 5,682,412 | A | 10/1997 | Skillicorn et al. |
| 5,696,808 | A | 12/1997 | Lenz |
| 5,729,583 | A | 3/1998 | Tang et al. |
| 5,812,632 | A | 9/1998 | Schardt et al. |
| 5,907,595 | A | 5/1999 | Sommerer |
| 5,978,446 | A | 11/1999 | Resnick |
| 6,005,918 | A | 12/1999 | Harris et al. |
| 6,044,130 | A | 3/2000 | Inazura et al. |
| 6,069,278 | A | 5/2000 | Chuang |
| 6,073,484 | A | 6/2000 | Miller et al. |
| 6,075,839 | A | 6/2000 | Treseder |
| 6,097,790 | A | 8/2000 | Hasegawa et al. |
| 6,129,901 | A | 10/2000 | Moskovits et al. |
| 6,133,401 | A | 10/2000 | Jensen |
| 6,134,300 | A | 10/2000 | Trebes et al. |
| 6,184,333 | B1 | 2/2001 | Gray |
| 6,205,200 | B1 | 3/2001 | Boyer et al. |
| 6,277,318 | B1 | 8/2001 | Bower |
| 6,282,263 | B1 | 8/2001 | Arndt et al. |
| 6,288,209 | B1 | 9/2001 | Jensen |
| 6,307,008 | B1 | 10/2001 | Lee et al. |
| 6,320,019 | B1 | 11/2001 | Lee et al. |
| 6,351,520 | B1 | 2/2002 | Inazaru |
| 6,385,294 | B2 | 5/2002 | Suzuki et al. |
| 6,388,359 | B1 | 5/2002 | Duelli et al. |
| 6,438,207 | B1 | 8/2002 | Chidester et al. |
| 6,477,235 | B2 | 11/2002 | Chornenky et al. |
| 6,487,272 | B1 | 11/2002 | Kutsuzawa |
| 6,487,273 | B1 | 11/2002 | Takenaka et al. |
| 6,494,618 | B1 | 12/2002 | Moulton |
| 6,546,077 | B2 | 4/2003 | Chornenky et al. |
| 6,567,500 | B2 | 5/2003 | Rother |
| 6,658,085 | B2 | 12/2003 | Sklebitz et al. |
| 6,661,876 | B2 | 12/2003 | Turner et al. |
| 6,740,874 | B2 | 5/2004 | Doring |
| 6,778,633 | B1 | 8/2004 | Loxley et al. |
| 6,799,075 | B1 | 9/2004 | Chornenky et al. |
| 6,803,570 | B1 | 10/2004 | Bryson, III et al. |
| 6,816,573 | B2 | 11/2004 | Hirano et al. |
| 6,819,741 | B2 | 11/2004 | Chidester |
| 6,852,365 | B2 | 2/2005 | Smart et al. |
| 6,853,568 | B2 * | 2/2005 | Li et al. ..... 363/65 |
| 6,866,801 | B1 | 3/2005 | Mau et al. |
| 6,876,724 | B2 | 4/2005 | Zhou |
| 6,956,706 | B2 | 10/2005 | Brandon |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,049,735 | B2 | 5/2006 | Ohkubo et al. |
| 7,050,539 | B2 | 5/2006 | Loef et al. |
| 7,054,411 | B2 * | 5/2006 | Katcha et al. ..... 378/101 |
| 7,075,699 | B2 | 7/2006 | Oldham et al. |
| 7,085,354 | B2 | 8/2006 | Kanagami |
| 7,108,841 | B2 | 9/2006 | Smalley |
| 7,110,498 | B2 | 9/2006 | Yamada |
| 7,130,380 | B2 | 10/2006 | Lovoi et al. |
| 7,130,381 | B2 | 10/2006 | Lovoi et al. |
| 7,203,283 | B1 | 4/2007 | Puusaari |
| 7,206,381 | B2 | 4/2007 | Shimono et al. |
| 7,215,741 | B2 | 5/2007 | Ukita |
| 7,224,769 | B2 | 5/2007 | Turner |
| 7,233,647 | B2 | 6/2007 | Turner et al. |
| 7,286,642 | B2 | 10/2007 | Ishikawa et al. |
| 7,305,065 | B2 * | 12/2007 | Takahashi et al. ..... 378/104 |
| 7,305,066 | B2 | 12/2007 | Ukita |
| 7,317,784 | B2 | 1/2008 | Durst et al. |
| 7,358,593 | B2 | 4/2008 | Smith et al. |
| 7,382,862 | B2 | 6/2008 | Bard et al. |
| 7,428,298 | B2 | 9/2008 | Bard et al. |
| 7,448,801 | B2 | 11/2008 | Oettinger et al. |
| 7,486,774 | B2 | 2/2009 | Cain |
| 7,526,068 | B2 | 4/2009 | Dinsmore |
| 7,529,345 | B2 | 5/2009 | Bard et al. |
| 7,634,052 | B2 | 12/2009 | Grodzins et al. |
| 7,649,980 | B2 | 1/2010 | Aoki et al. |
| 7,650,050 | B2 | 1/2010 | Haffner et al. |
| 7,657,002 | B2 | 2/2010 | Burke et al. |

(56) References Cited

U.S. PATENT DOCUMENTS

| | | | | |
|---|---|---|---|---|
| 7,675,444 | B1 | 3/2010 | Smith et al. | |
| 7,680,652 | B2 | 3/2010 | Giesbrecht et al. | |
| 7,693,265 | B2 | 4/2010 | Hauttmann et al. | |
| 7,709,820 | B2 | 5/2010 | Decker et al. | |
| 7,737,424 | B2 | 6/2010 | Xu et al. | |
| 7,756,251 | B2 | 7/2010 | Davis et al. | |
| 7,826,586 | B2 * | 11/2010 | Nakayama et al. | 378/15 |
| 8,242,704 | B2 * | 8/2012 | Lethellier | 315/276 |
| 8,331,533 | B2 * | 12/2012 | Yamamoto | 378/101 |
| 8,526,574 | B2 * | 9/2013 | Wang et al. | 378/107 |
| 8,581,437 | B2 * | 11/2013 | Delforge | 307/11 |
| 8,598,807 | B2 * | 12/2013 | Ji et al. | 315/294 |
| 8,774,365 | B2 * | 7/2014 | Wang | 378/111 |
| 8,804,910 | B1 * | 8/2014 | Wang et al. | 378/101 |
| 2003/0096104 | A1 | 5/2003 | Tobita et al. | |
| 2003/0152700 | A1 | 8/2003 | Asmussen et al. | |
| 2003/0165418 | A1 | 9/2003 | Ajayan et al. | |
| 2004/0076260 | A1 | 4/2004 | Charles, Jr. et al. | |
| 2005/0018817 | A1 | 1/2005 | Oettinger et al. | |
| 2005/0141669 | A1 | 6/2005 | Shimono et al. | |
| 2005/0207537 | A1 | 9/2005 | Ukita | |
| 2006/0073682 | A1 | 4/2006 | Furukawa et al. | |
| 2006/0098778 | A1 | 5/2006 | Oettinger et al. | |
| 2006/0210020 | A1 | 9/2006 | Takahshi et al. | |
| 2006/0233307 | A1 | 10/2006 | Dinsmore | |
| 2006/0269048 | A1 | 11/2006 | Cain | |
| 2006/0280289 | A1 | 12/2006 | Hanington et al. | |
| 2007/0025516 | A1 | 2/2007 | Bard et al. | |
| 2007/0111617 | A1 | 5/2007 | Meilahti | |
| 2007/0172104 | A1 | 7/2007 | Nishide | |
| 2007/0183576 | A1 | 8/2007 | Burke et al. | |
| 2007/0217574 | A1 | 9/2007 | Beyerlein | |
| 2008/0296479 | A1 | 12/2008 | Anderson et al. | |
| 2008/0296518 | A1 | 12/2008 | Xu et al. | |
| 2008/0317982 | A1 | 12/2008 | Hecht | |
| 2009/0085426 | A1 | 4/2009 | Davis et al. | |
| 2009/0086923 | A1 | 4/2009 | Davis et al. | |
| 2009/0213914 | A1 | 8/2009 | Dong et al. | |
| 2009/0243028 | A1 | 10/2009 | Dong et al. | |
| 2010/0098216 | A1 | 4/2010 | Dobson | |
| 2010/0126660 | A1 | 5/2010 | O'Hara | |
| 2010/0189225 | A1 | 7/2010 | Ernest et al. | |
| 2010/0243895 | A1 | 9/2010 | Xu | |
| 2010/0285271 | A1 | 11/2010 | Davis et al. | |

FOREIGN PATENT DOCUMENTS

| | | |
|---|---|---|
| DE | 19818057 | 11/1999 |
| EP | 0 297 808 | 1/1989 |
| EP | 0330456 | 8/1989 |
| GB | 1252290 | 11/1971 |
| JP | 57 082954 | 8/1982 |
| JP | 3170673 | 7/1991 |
| JP | 5066300 | 3/1993 |
| JP | 06 119893 | 7/1994 |
| JP | 2003211396 | 7/2003 |
| JP | 2006297549 | 11/2008 |
| WO | WO2008/052002 | 5/2008 |
| WO | WO 2012/039823 | 3/2012 |

OTHER PUBLICATIONS

Flahaut, E. et al, "Carbon Nanotube-metal-oxide nanocomposites; microstructure, electrical conductivity and mechanical properties," Acta mater., 2000, pp. 3803-3812.Vo. 48.

Gevin et al., "IDeF-X V1.0: performances of a new CMOS multi channel analogue readout ASIC for Cd(Zn)Te detectors", IDDD, Oct. 2005, 433-437, vol. 1, 2005.

Grybos et al., "DEDIX—development of fully integrated multichannel ASCI for high count rate digital x-ray imaging systems", IEEE, 693-696, vol. 2.

Grybos et al., "Measurements of matching and high count rate performance of mulitchannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

http://www.orau.org/ptp/collectio/xraytubescollidge/MachlettCW250T.htm, 1999, 2 pages.

Hutchison, "Vertically aligned carbon nanotubes as a framework for microfabrication of high aspect ration mems," 2008, pp. 1-50.

Jiang, Linquin et al., "Carbon nanotubes-metal nitride composites; a new class of nanocomposites with enhanced electrical properties," J. Mater. Chem., 2005, pp. 260-266, vol. 15.

Li, Jun et al., "Bottom-up approach for carbon nanotube interconnects," Applied Physics Letters, Apr. 14, 2003, pp. 2491-2493, vol. 82 No. 15.

Ma. R.Z., et al., "Processing and properties of carbon nanotubes-nano-SIC ceramic", Journal of Materials Science 1998, pp. 5243-5246, vol. 33.

Micro X-ray Tube Operation Manual, X-ray and Specialty Instruments Inc., 1996, 5 pages.

Peigney, et al., "Carbon nanotubes in novel ceramic matrix nanocomposites," Ceramics International, 2000, pp. 677-683, vol. 26.

Rankov et al., "A novel correlated double sampling poly-Si circuit for readout systems in large area x-ray sensors", IEEE, May 2005, 728-731, vol. 1.

Sheather, "The support of thin windows for x-ray proportional counters," Journal Phys,E., Apr. 1973, pp. 319-322, vol. 6, No. 4.

Tamura et al., "Development of ASICs for CdTe pixel and line sensors", Oct. 2005, 2023-2029, vol. 52, Issue 5.

Wagner et al., "Effects of scatter in dual-energy imaging: an alternative analysis", Sep. 1989, 236-244, vol. 8, Issue 3.

Yan, Xing-Bin, et al., Fabrications of Three-Dimensional ZnO—Carbon Nanotube (CNT) Hybrids Using Self-Assembled CNT Micropatterns as Framework, 2007. pp. 17254-17259, vol. III.

Vajtai et al.; Building Carbon Nanotubes and Their Smart Architectures; Smart Mater. Struct.; 2002; vol. 11; pp. 691-698.

PCT Application No. PCT/US2011/044168; filedMar. 28, 2012; Kang Hyun II; report mailed Mar. 28, 2012.

Chakrapani et al.; Capillarity-Driven Assembly of Two-Dimensional Cellular Carbon Nanotube Foams; PNAS; Mar. 23, 2004; pp. 4009-4012; vol. 101; No. 12.

U.S. Appl. No. 12/899,750, filed Oct. 7, 2010; Steven Liddiard.

U.S. Appl. No. 13/018,667, filed Feb. 1, 2011; Robert C. Davis.

U.S. Appl. No. 13/307,579, filed Nov. 30, 2011; Dongbing Wang.

U.S. Appl. No. 12/890,325, filed Sep. 24, 2010; Dongbing Wang; office action dated Sep. 7, 2012.

* cited by examiner

COMPACT X-RAY SOURCE

BACKGROUND

A desirable characteristic of some high voltage devices, such as x-ray sources, especially portable x-ray sources, is small size. An x-ray source is comprised of an x-ray tube and a power supply. Transformers and a high voltage sensing resistor in the power supply can significantly cause the power supply to be larger than desirable.

An x-ray source can have a high voltage sensing resistor used in a circuit for sensing the tube voltage. The high voltage sensing resistor, due to a very high voltage across the x-ray tube, such as around 10 to 200 kilovolts, can have a very high required resistance, such as around 10 mega ohms to 100 giga ohms. The high voltage sensing resistor can be a surface mount resistor and the surface of the substrate that holds the resistor material can have surface dimensions of around 12 mm by 50 mm in some power supplies. Especially in miniature and portable x-ray tubes, the size of this resistor can be an undesirable limiting factor in reduction of size of a power supply for these x-ray tubes.

X-ray tubes can have a transformer ("filament transformer") for transferring an alternating current signal from an alternating current (AC) source at low bias voltage to an x-ray tube electron emitter, such as a filament, at a very high direct current (DC) voltage, or bias voltage, such as around 10 to 200 kilovolts. A hot filament, caused by the alternating current, and the high bias voltage of the filament, relative to an x-ray tube anode, results in electrons leaving the filament and propelled to the anode. U.S. Pat. No. 7,839,254, incorporated herein by reference, describes one type of filament transformer.

X-ray tubes can also have a transformer (called a "high voltage transformer" or "HV transformer" herein) for stepping up low voltage AC, such as around 10 volts, to higher voltage AC, such as above 1 kilovolt. This higher voltage AC can be used in a high voltage generator, such as a Cockcroft-Walton multiplier, to generate the very high bias voltage, such as around 10 to 200 kilovolts, of the x-ray tube filament or cathode with respect to the anode. The size of both the high voltage transformer and the filament transformer can be a limiting factor in reduction of the size of the x-ray source.

SUMMARY

It has been recognized that it would be advantageous to have a smaller, more compact, high voltage device, such as an x-ray source. The present invention is directed towards a more compact, smaller high voltage device, including smaller, more compact x-ray sources.

In one embodiment, the present invention is directed to a circuit for supplying AC power to a load in a circuit in which there is a large DC voltage differential between an AC power source and the load. Capacitors are used to provide voltage isolation while providing efficient transfer of AC power from the AC power source to the load. The DC voltage differential can be at least about 1 kV. In an x-ray source, these capacitors can replace the filament transformer. This invention satisfies the need for a compact, smaller high voltage device, such as a compact, smaller x-ray source.

The present invention can be used in an x-ray tube in which (1) the load can be an electron emitter which is electrically isolated from an anode, and (2) there exists a very large DC voltage differential between the electron emitter and the anode. AC power supplied to the electron emitter can heat the electron emitter and due to such heating, and the large DC voltage differential between the electron emitter and the anode, electrons can be emitted from the electron emitter and propelled towards the anode.

In another embodiment of the present invention, only one transformer for an electron emitter and a high voltage generator, is needed, by connecting a first alternating current source for the electron emitter or filament in parallel with the input to the high voltage generator thus reducing size and cost by using a the high voltage generator for voltage isolation rather than using a separate transformer for voltage isolation. Thus the capacitors of the high voltage generator provide isolation between the electron emitter or filament, at very high DC voltage, and the alternating current source for the electron emitter or filament, which is at a low DC voltage potential.

In another embodiment of the present invention, two different circuits can utilize the same transformer core, thus reducing size and cost by utilizing one core instead of two. Each can have a different frequency in order to avoid one circuit from interfering with the other circuit. The input circuit for each can have a frequency that is about the same as the resonant frequency of the output circuit.

In another embodiment of the present invention, the high voltage sensing resistor can be disposed directly on the cylinder of the x-ray tube. Thus by having the high voltage sensing resistor directly on the cylinder of the x-ray tube, space required by this resistor is negligible, allowing for a more compact power supply of the x-ray source. An additional possible benefit of the sensing resistor can be improved tube stability due to removal of static charge on the surface of the x-ray tube cylinder that was generated by the electrical field within x-ray tube.

DEFINITIONS

Figure 1:
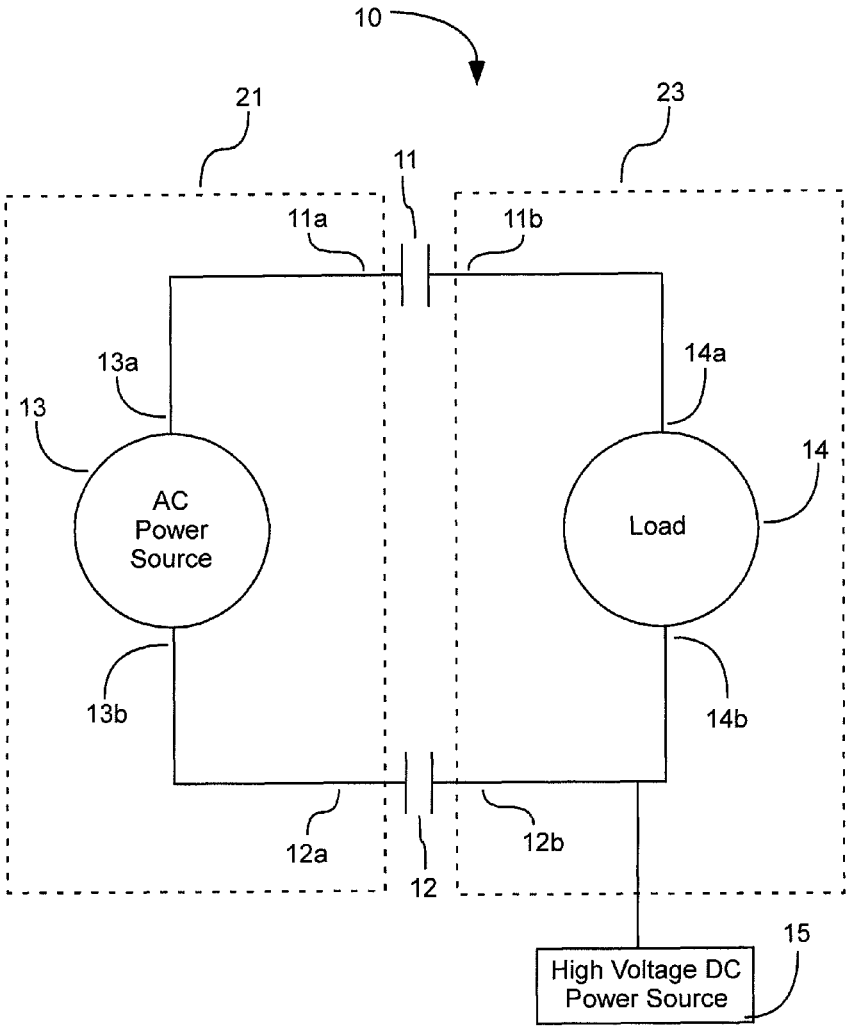
FIG. 1 is a schematic of a circuit for supplying alternating current to a load, with a high voltage DC power source on the load side of the circuit, in accordance with an embodiment of the present invention.

As used in this description and in the appended claims, the following terms are defined As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, the term "about" is used to provide flexibility to a numerical range endpoint by providing that a given value may be "a little above" or "a little below" the endpoint.

As used herein, the term "capacitor" means a single capacitor or multiple capacitors in series.

As used herein, the term "high voltage" or "higher voltage" refer to the DC absolute value of the voltage. For example, negative 1 kV and positive 1 kV would both be considered to be "high voltage" relative to positive or negative 1 V. As another example, negative 40 kV would be considered to be "higher voltage" than 0 V.

As used herein, the term "low voltage" or "lower voltage" refer to the DC absolute value of the voltage. For example, negative 1 V and positive 1 V would both be considered to be "low voltage" relative to positive or negative 1 kV. As another example, positive 1 V would be considered to be "lower voltage" than 40 kV.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Capacitor AC Power Coupling Across High DC Voltage Differential

As illustrated in FIG. 1, a circuit, shown generally at 10, for supplying AC power to a load 14, includes an AC power source 13 having a first connection 13*a* and a second connection 13*b*, a first capacitor 11 having a first connection 11*a* and a second connection 11*b*, and a second capacitor 12 having a first connection 12*a* and a second connection 12*b*. The first connection of the AC power source 13*a* is connected to the first connection 11*a* on the first capacitor 11. The second connection 13*b* of the AC power source 13 is connected to the first connection 12*a* on the second capacitor 12. The AC power source 13, the first and second connections 13*a* and 13*b* on the AC power source 13, the first connection 11*a* on the first capacitor 11, and the first connection 12*a* on the second capacitor 12 comprise a first voltage side 21 of the circuit 10.

The circuit 10 for supplying AC power to a load 14 further comprises the load 14 having a first connection 14*a* and a second connection 14*b*. The second connection 11*b* of the first capacitor 11 is connected to the first connection 14*a* on the load 14 and the second connection 12*b* of the second capacitor 12 is connected to the second connection 14*b* on the load 14. The load 14, the first and second connections 14*a* and 14*b* on the load 14, the second connection 11*b* on the first capacitor 11, and the second connection 12*b* on the second capacitor 12 comprise a second voltage side 23 of the circuit 10.

The first and second capacitors 11, 12 provide voltage isolation between the first and second voltage sides 21, 23 of the circuit 10, respectively. A high voltage DC source 15 can provide at least 1 kV DC voltage differential between the first 21 and second 23 voltage sides of the circuit.

Figure 2:
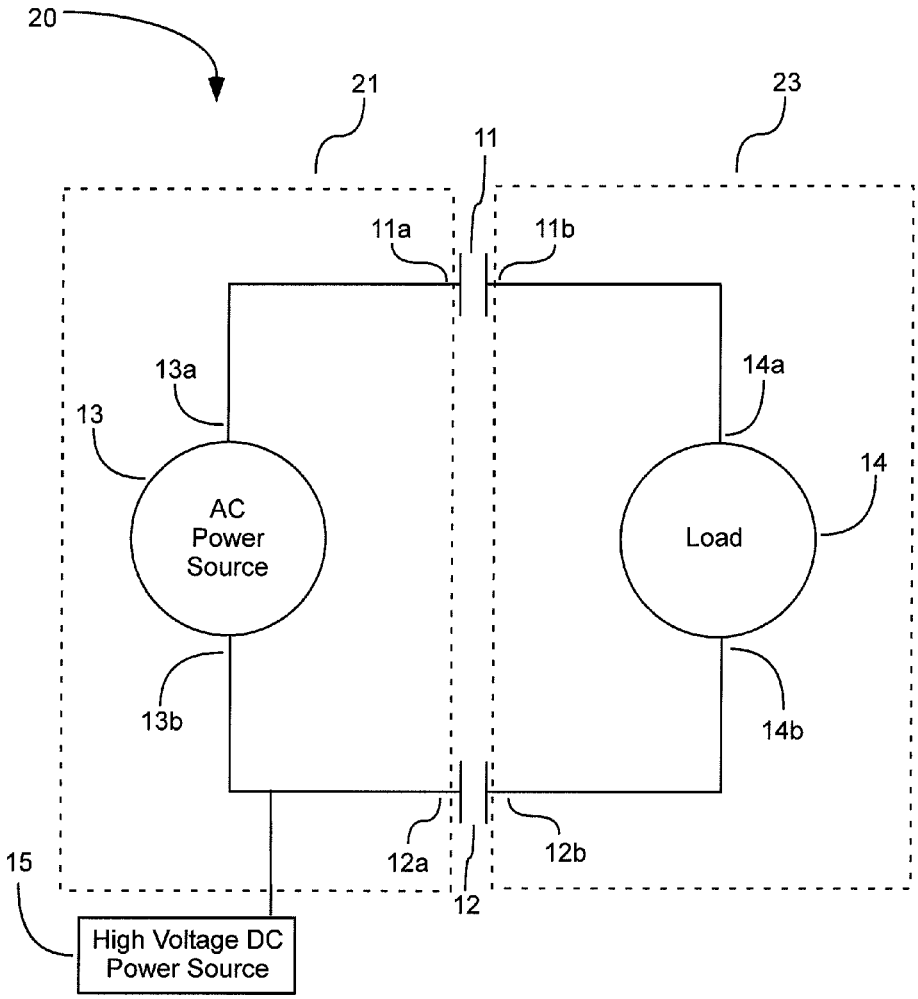
FIG. 2 is a schematic of a circuit for supplying alternating current to a load, with a high voltage DC power source on the AC power source side of the circuit, in accordance with an embodiment of the present invention.
Figure 3:
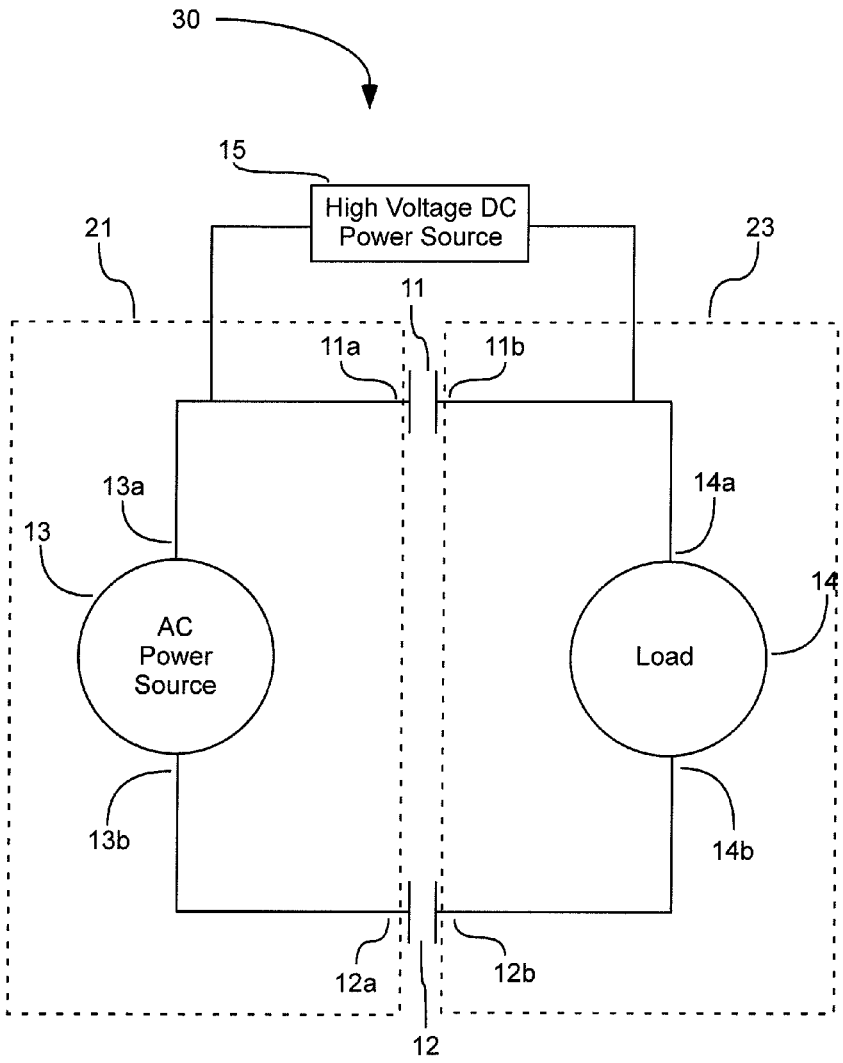
FIG. 3 is a schematic of a circuit for supplying alternating current to a load, with a high voltage DC power source connected between the load side of the circuit and the AC power source side of the circuit, in accordance with an embodiment of the present invention.

As shown in FIG. 1, the high voltage DC power source 15 can be electrically connected to the second voltage side 23 of the circuit 10, such that the second voltage side 23 of the circuit 10 is a substantially higher voltage than the first voltage side 21 of the circuit 10. Alternatively, as shown in FIG. 2, the high voltage DC power source 15 can be electrically connected to the first voltage side 21 of the circuit 20, such that the first voltage side 21 of the circuit 20 has a substantially higher voltage than the second voltage side 23 of the circuit 20. As shown in FIG. 3, the high voltage DC power source 15 can be electrically connected between the first 21 and second 23 voltage sides of the circuit 30 to provide a large DC voltage potential between the two sides 21 and 23 of the circuit 30.

The DC voltage differential between the first 21 and second 23 voltage sides of the circuit can be substantially greater than 1 kV. For example the DC voltage differential between the first and second voltage sides 21 and 23 of the circuit 30 can be greater than about 4 kV, greater than about 10 kV, greater than about 20 kV, greater than about 40 kV, or greater than about 60 kV.

The AC power source 13 can transfer at least about 0.1 watt, at least about 0.5 watt, at least about 1 watt, or at least about 10 watts of power to the load 14.

Sometimes a circuit such as the example circuit displayed in FIGS. 1-3 needs to be confined to a small space, such as for use in a portable tool. In such a case, it is desirable for the capacitors 11 and 12 to have a small physical size. Capacitors with lower capacitance C are typically smaller in physical size. However, use of a capacitor with a lower capacitance can also result in an increased capacitive reactance $X_c$. A potential increase in capacitive reactance $X_c$ due to lower capacitance C of the capacitors can be compensated for by increasing the frequency f supplied by the AC power source, as shown in the formula:

$$X_c = \frac{1}{2*\pi*f*C}.$$

In selected embodiments of the present invention, the capacitance of the first and second capacitors 11 and 12 can be greater than about 10 pF or in the range of about 10 μF to about 1 μF. In selected embodiments of the present invention the alternating current may be supplied to the circuit 10 at a frequency f of at least about 1 MHz, at least about 500 MHz, or at least about 1 GHz.

For example, if the capacitance C is 50 pF and the frequency f is 1 GHz, then the capacitive reactance $X_c$ is about 3.2. In selected embodiments of the present invention, the capacitive reactance $X_c$ of the first capacitor 11 can be in the range of 0.2 to 12 ohms and the capacitive reactance $X_c$ of the second capacitor 12 can be in the range of 0.2 to 12 ohms.

It may be desirable, especially in very high voltage applications, to use more than one capacitor in series. In deciding the number of capacitors in series, manufacturing cost, capacitor cost, and physical size constraints of the circuit may be considered. Accordingly, the first capacitor 11 can comprise at least 2 capacitors connected in series and the second capacitor 12 can comprise at least 2 capacitors connected in series.

In one embodiment, the load 14 in the circuit 10 can be an electron emitter such as a filament in an x-ray tube.

Figure 4:
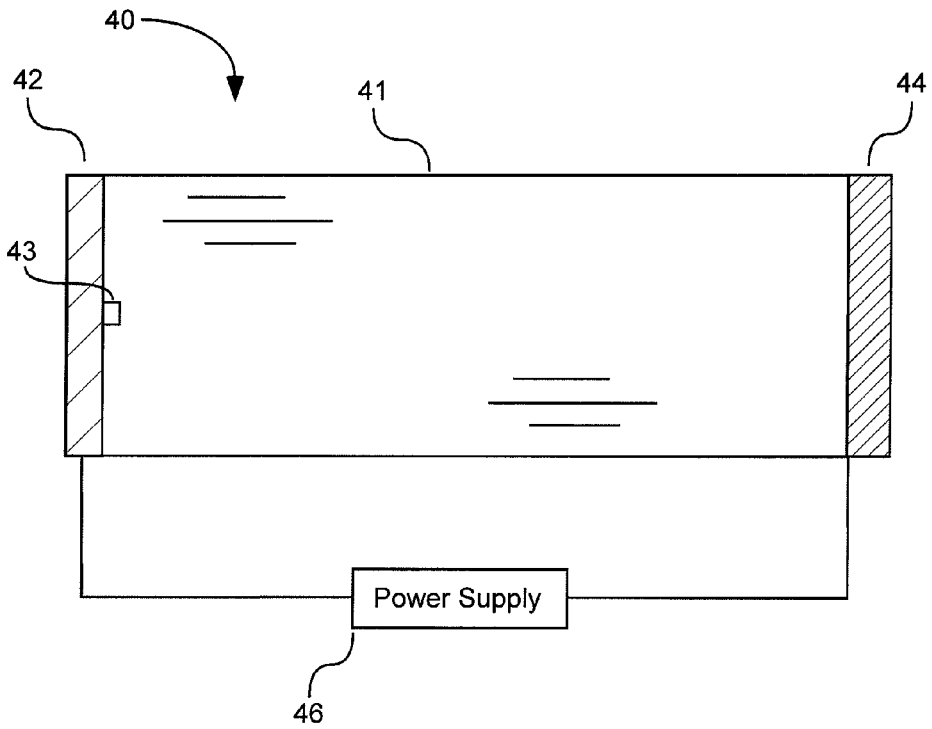
FIG. 4 is a schematic cross-sectional side view of an x-ray tube utilizing a circuit for supplying alternating current to a load in accordance with an embodiment of the present invention.

As shown in FIG. 4, the circuits 10, 20, 30 for supplying AC power to a load 14 as described above and shown in FIGS. 1-3 may be used in an x-ray tube 40. The x-ray tube 40 can comprise an evacuated dielectric tube 41 and an anode 44 that is disposed at an end of the evacuated dielectric tube 41. The anode 44 can include a material that is configured to produce x-rays in response to the impact of electrons, such as silver, rhodium, tungsten, or palladium. The x-ray tube 40 further comprises a cathode 42 that is disposed at an opposite end of the evacuated dielectric tube 41 opposing the anode 44. The cathode 42 can include an electron emitter 43, such as a filament, that is configured to produce electrons which can be accelerated towards the anode 44 in response to an electric field between the anode 44 and the cathode 42.

A power supply 46 can be electrically coupled to the anode 44, the cathode 42, and the electron emitter 43. The power supply 46 can include an AC power source 13 for supplying AC power to the electron emitter 43 in order to heat the electron emitter 43, as described above and shown in FIGS. 1-3. The power supply 46 can also include a high voltage DC power source 15 connected to at least one side of the circuit and configured to provide: (1) a DC voltage differential between the first and second voltage sides 21 and 23 of the circuit; and (2) the electric field between the anode 44 and the cathode 42. The DC voltage differential between the first and second voltage sides 21 and 23 of the circuit can be provided as described above and shown in FIGS. 1-3.

Thus, the capacitors 11-12 can replace a transformer, such as a filament transformer in an x-ray source. This invention satisfies the need for a compact, smaller high voltage device, such as a compact, smaller x-ray source.

Methods for Providing AC Power to a Load

Figure 5:
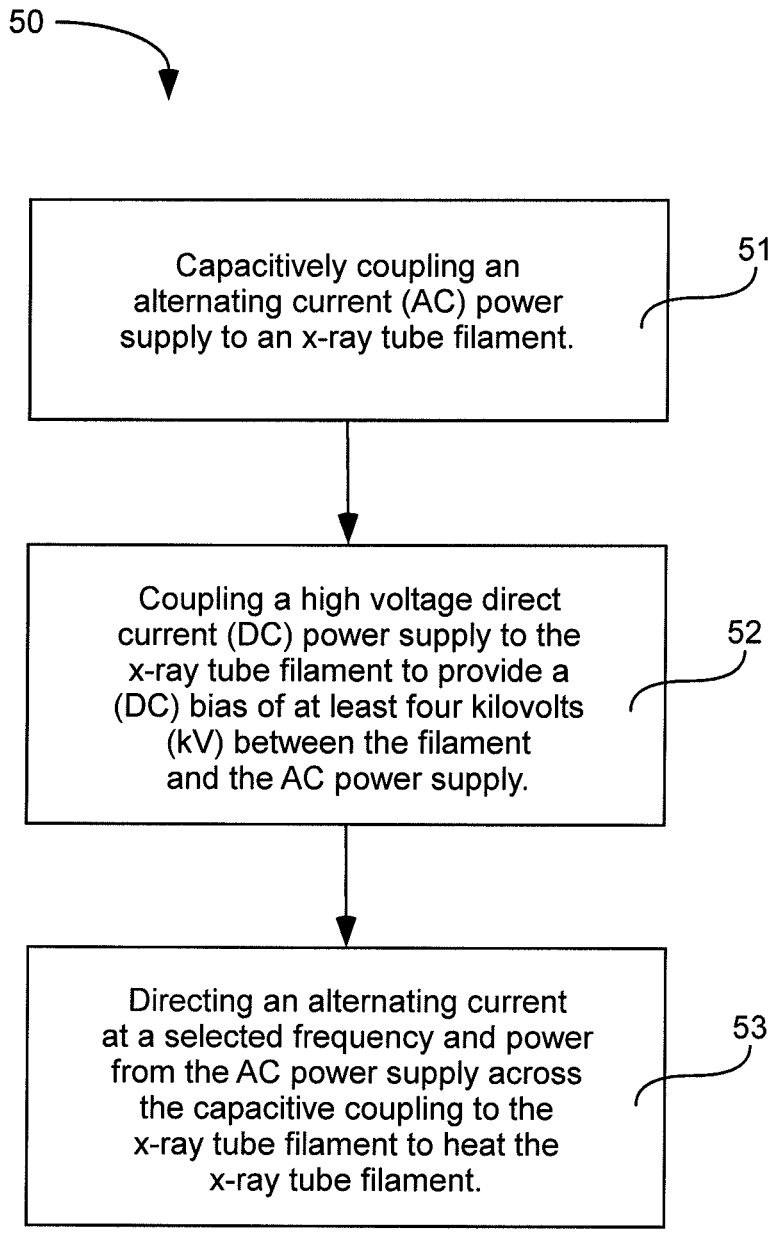
FIG. 5 is a flow chart depicting a method for heating an electron emitter in an x-ray tube in accordance with an embodiment of the present invention.

In accordance with another embodiment of the present invention, a method 50 for providing AC power to a load 14 is disclosed, as depicted in the flow chart of FIG. 5. The method 50 can include capacitively coupling 51 an AC power source 13 to a load 14. A high voltage DC power source 15 can be coupled 52 to one of the load 14 or the AC power source 13 to provide a DC bias of at least four kilovolts (kV) between the load 14 and the AC power source 13. An alternating current at a selected frequency and power can be directed 53 from the AC power source 13 across the capacitive coupling to the load 14.

The high voltage DC power source 15 can provide a DC voltage differential between the load 14 and the AC power source 13 that is substantially higher than 1 kV. For example the DC voltage differential can be greater than about 4 kV, greater than about 20 kV, greater than about 40 kV, or greater than about 60 kV.

In various embodiments of the present invention, the power transferred to the load 14 can be at least about 0.1 watt, at least about 0.5 watt, at least about 1 watt, or at least about 10 watts. In various embodiments of the present invention, the AC power source 13 can be capacitively coupled to the load 14 with single capacitors or capacitors in series. The capacitance of the capacitors, or capacitors in series, can be greater than about 10 pF or in the range of about 10 pF to about 1 μF. In embodiments of the present invention the selected frequency may be at least about 1 MHz, at least about 500 MHz, or at least about 1 GHz.

In the above described methods, the AC power coupled to the load 14 can be used to heat the load 14. The load 14 can be an x-ray tube electron emitter 43, such as a filament.

Load Driven by HV Multiplier Capacitors

Figure 6:
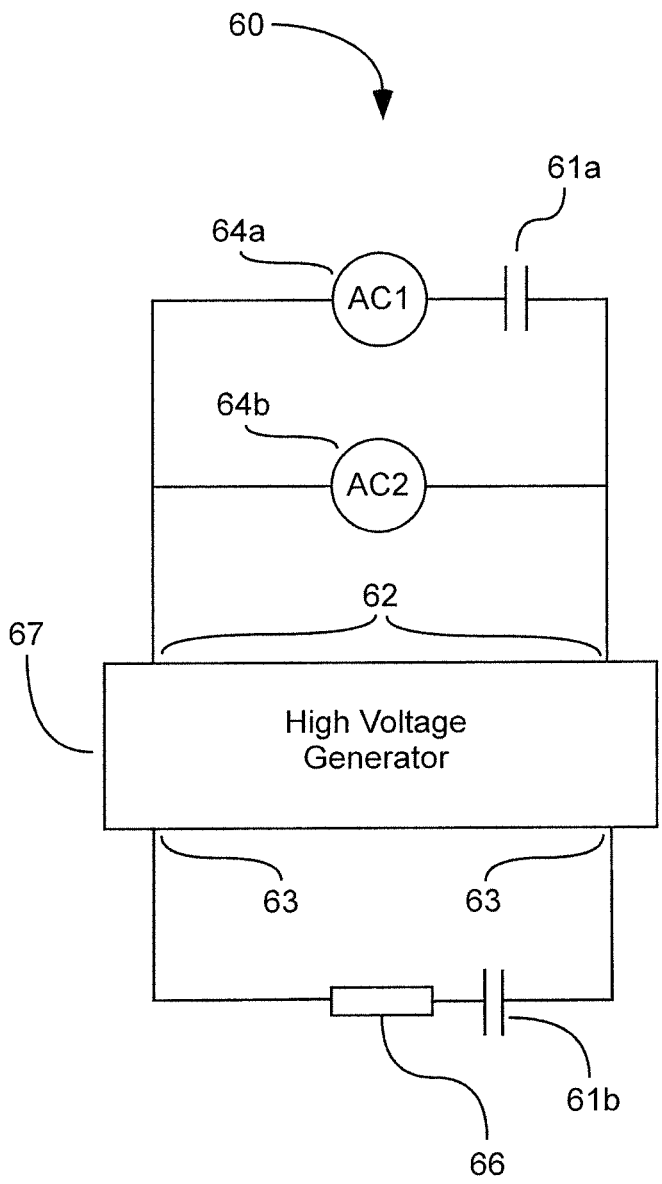
FIG. 6 is a schematic cross-sectional side view of a power source in which a high voltage multiplier is used to separate an alternating current source, at low or zero bias voltage, from a load at a very high bias voltage, which load is powered by this alternating current source.

As illustrated in FIG. 6, a power source 60 is shown comprising a first alternating current source 64*a* connected in series with a first capacitor 61*a*. The first alternating current source 64*a* can be configured to operate at a first amplitude or peak voltage of about 10 volts. In one embodiment, the first amplitude can be less than about 20 volts. The first alternating current source 64*a* can have a bias voltage of 0 so that for example the voltage can alternate between about +10 and −10 volts. The first alternating current source 64*a* can be configured to be operated at a first frequency. In one embodiment, the first frequency can have a value of greater than about 10 megahertz. In another embodiment, the first frequency can have a value of greater than about 100 megahertz.

The power source 60 further comprises a second alternating current source 64*b* connected in parallel with the first alternating current source 64*a* and the first capacitor 61*a*. The second alternating current source 64*b* can be configured to operate at a second amplitude or peak voltage of about 100 volts. In one embodiment, the second amplitude can be greater than about 1 kilovolts DC. The second alternating current source 64*b* can have a bias voltage of 0 so that for example the voltage can alternate between about +100 and −100 volts. The second alternating current source 64*b* can be configured to be operated at a second frequency. In one embodiment, the second frequency can have a value of between about 10 kilohertz to about 10 megahertz.

The power source 60 further comprises a high voltage generator 67 having two connection points at a low voltage end 62 and two connection points at a high voltage end 63.

The high voltage generator 67 can develop a voltage differential between the low voltage end and the high voltage end of greater than about 10 kilovolts. The first alternating current source 64*a* and the first capacitor 61*a* and the second alternating current source 64*b* can be connected in parallel with the two connection points 62 at the low voltage end of the high voltage generator 67.

The power source 60 further comprises a load 66 connected in parallel with the two connection points 63 at the high voltage end of the high voltage generator 67. A second capacitor 61*b* can be connected in series with a load 66.

In one embodiment, the first frequency can have a value that is at least 3 times greater than the second frequency. In another embodiment, the first frequency can have a value that is at least 10 times greater than the second frequency. It can be desirable to have a very large difference between the first and second frequency. A relatively lower second frequency can result in a high impedance to the alternating current from the second alternating current source 64*b* at the first capacitor 61*a* and at the second capacitor 61*b*. This minimizes any influence from the higher amplitude second alternating current source 64*b* on the first alternating current source 64*a* and load 66. A higher first frequency allows the alternating current from the first alternating current source 64*a* to pass the first capacitor 61*a* and the second capacitor 61*b* with smaller voltage drop.

In one embodiment, the second amplitude can have a value that is at least 3 times greater than the first amplitude. In another embodiment, the second amplitude can have a value that is at least 10 times greater than the first amplitude. It can be desirable for the first amplitude to be lower because alternating current from the first alternating current source 64*a* can be used for heating the x-ray tube filament and a lower amplitude, such as around 10 volts, can be sufficient for this purpose. Also, a lower first amplitude can result in minimal effect on the high voltage generator 67 from the first alternating current source 64*a*. It can be desirable for the second amplitude to be higher because alternating current from the second alternating current source 64*b* can be used for generating a high bias voltage through the high voltage generator 67 and a higher amplitude, such as greater than around 100 volts, may be needed for this purpose.

Figure 7:
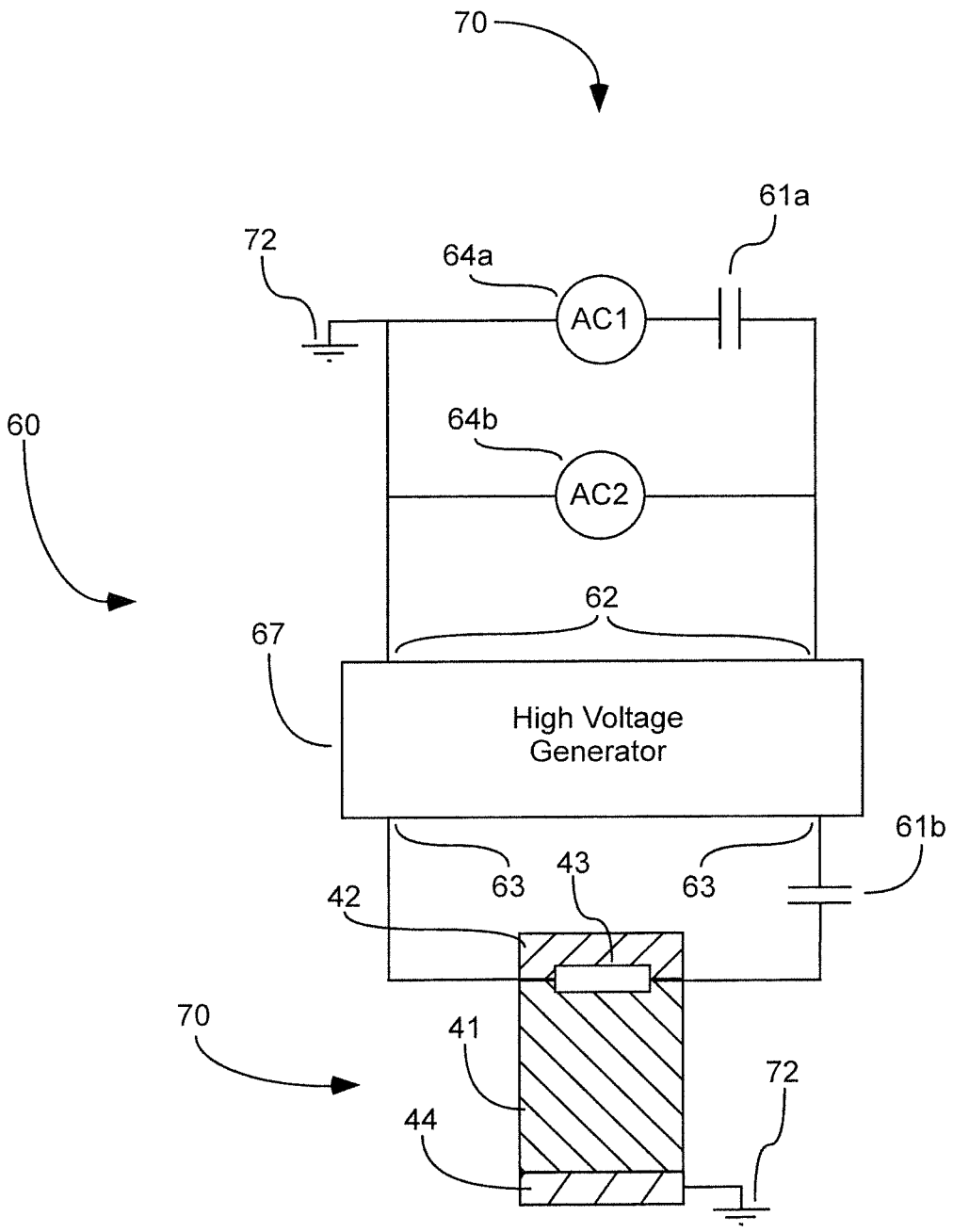
FIG. 7 is a schematic cross-sectional side view of a power source for an x-ray tube electron emitter in which a high voltage multiplier is used to separate an alternating current source, at low or zero bias voltage, from the electron emitter at a very high bias voltage, which electron emitter is powered by this alternating current source.

As shown in FIG. 7, the power source 60 described previously can be used to supply power to an x-ray source 70. The x-ray source 70 can comprise an x-ray tube 40 with an insulative cylinder 41, an anode 44 disposed at one end of the insulative cylinder 41, and a cathode 42 at an opposing end of the insulative cylinder 41 from the anode 44. The cathode 42 can include an electron emitter 43, such as a filament. The electron emitter 43 and the second capacitor 61*b* can be connected in series to each other and parallel to the connection points 63 at the high voltage end of the high voltage generator 67. The anode 44 can be electrically grounded to ground 72. The first alternating current source 64*a* can drive alternating current and power at the electron emitter 43. The second alternating current source 64*b* can create high voltage at the high voltage generator 67, creating a voltage differential between the cathode 42 and the anode 44 of greater than about 10 kilovolts. The voltage differential between the cathode 42 and the anode 44 and the alternating current at the electron emitter 43 can cause electrons to be emitted from the electron emitter 43 and propelled towards the anode 44.

Figure 8:
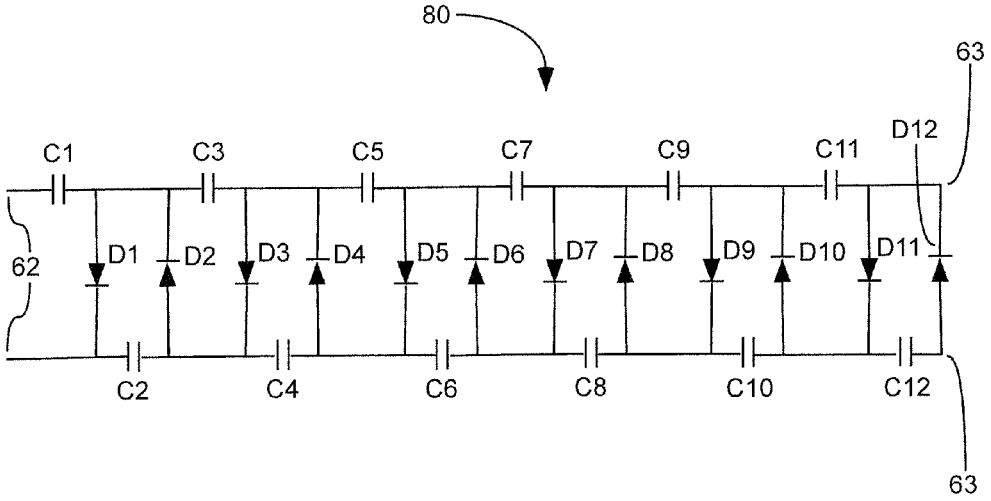
FIG. 8 is a schematic cross-sectional side view of a Cockcroft-Walton multiplier.

As shown in FIG. 8, the high voltage generator 67 can be a Cockcroft-Walton multiplier 80 with capacitors C1-C12 and diodes D1-D12. Diodes D1-D12 in the Cockcroft-Walton multiplier 80 can have a forward voltage of greater than about 10 volts. Diode D1-D12 forward voltage can be higher than the first amplitude such that alternating current from the first alternating current source 64*a* will not cause any substantial amount of current to pass through these diodes D1-D12.

Figure 9:
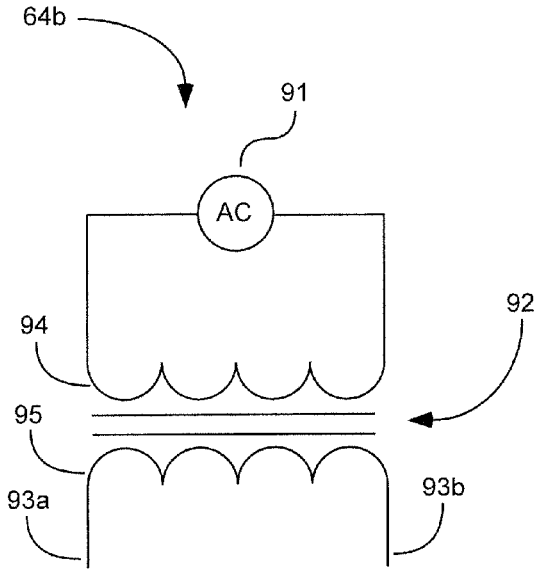
FIG. 9 is a schematic cross-sectional side view of an alternating current source and step-up transformer for supplying alternating current to a high voltage generator.

Shown in FIG. 9, the second alternating current source 64*b* can comprise an alternating current source 91 connected in series with input windings 94 on a step-up transformer 92. Output windings 95 on the step-up transformer 92 can be connected in parallel, at connection points 93*a-b*, with the first alternating current source 64*a* and the first capacitor 61*a*. In one embodiment, this configuration can allow use of an alternating current source 91 which can supply AC at an amplitude of around 10 volts to be used, along with the step-up transformer 92, to supply alternating current, at an amplitude of around 100 to 1000 volts, to the high voltage generator 67.

Capacitance of the first and second capacitors 61*a* and 61*b* can be chosen by balancing the desirability of higher capacitance for less power loss with lower capacitance for smaller physical size and lower cost. For example, the first capacitor 61*a* can have a capacitance of between about 10 picofarads to about 10 microfarads and the second capacitor 61*b* can have a capacitance of between about 10 picofarads to about 10 microfarads.

Multiple Channel Transformer

Figure 10:
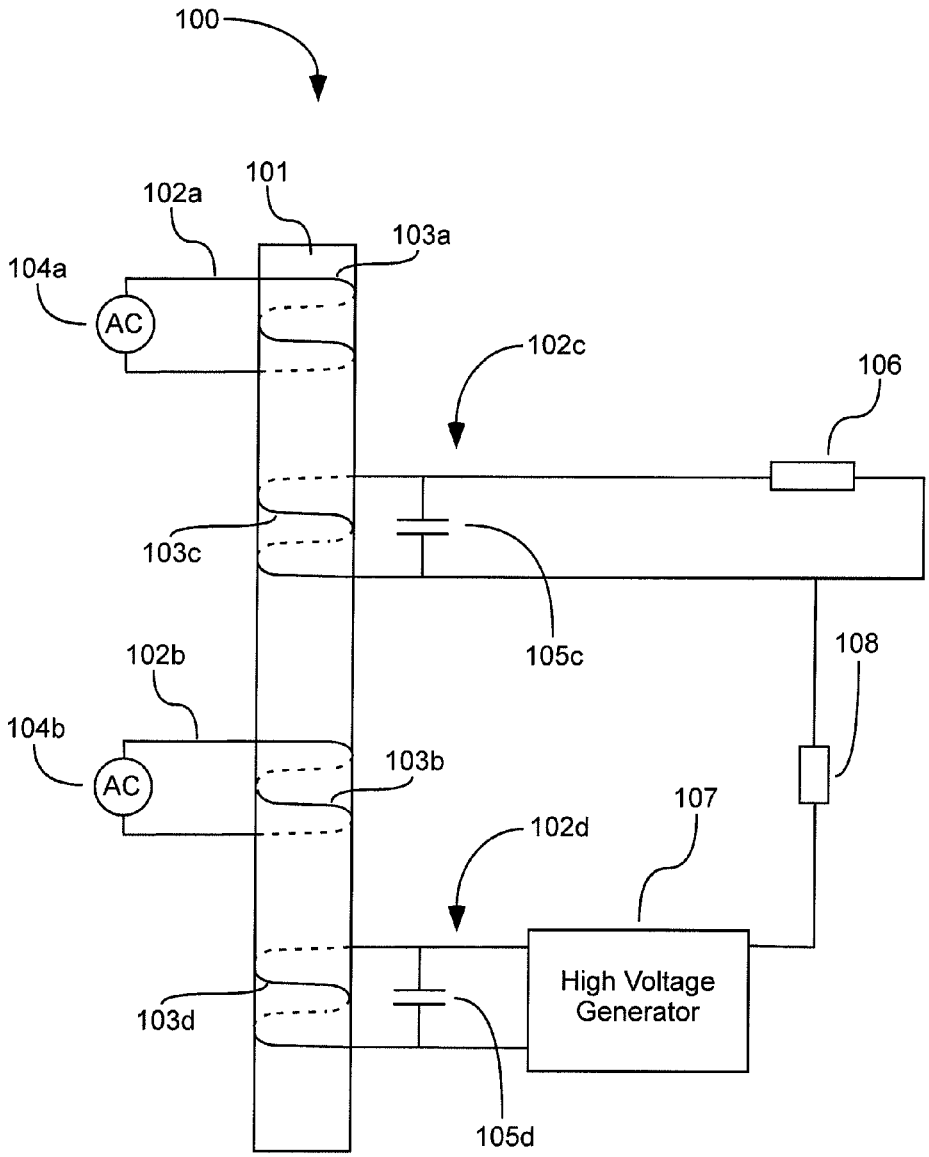
FIG. 10 is a schematic cross-sectional side view of a multiple channel transformer in which two circuits utilize the same transformer core.

As illustrated in FIG. 10, a multiple channel transformer 100 is shown comprising a single transformer core 101 with at least two input circuits 102*a-b* and at least two output circuits 102*c-d*.

A first input circuit 102*a* can be wrapped 103*a* at least one time around the single transformer core 101 and configured to carry an alternating current signal at a first frequency $F_1$. A first output circuit 102*c* comprises a first output winding 103*c*. The first output winding 103*c* can be wrapped at least one time around the single transformer core 101.

A second input circuit 102*b* can be wrapped 103*b* at least one time around the single transformer core 101 and configured to carry an alternating current signal at a second frequency $F_2$. A second output circuit 102*d* comprises a second output winding 103*d*. The second output winding 103*d* can be wrapped at least one time around the single transformer core 101.

The first output circuit 102*c* has a resonant frequency which can be the about the same as the first frequency $F_1$. The second output circuit 102*d* has a resonant frequency which can be about the same as the second frequency $F_2$. Circuit design resulting in substantially different resonant frequencies between the two output circuits 102*c-d* can result in (1) the first input circuit 102*a* inducing a current in the first output circuit 102*c* with negligible inducement of current from the second input circuit 102*b*, and (2) the second input circuit 102*b* inducing a current in the second output circuit 102*d* with negligible inducement of current from the first input circuit 102*a*. For example, the first frequency $F_1$ can be ten times or more greater than the second frequency $F_2$, $F_1 \geq 10*F_2$. The first frequency $F_1$ can be at least 10 to 1000 times greater than the second frequency $F_2$. Alternatively, the second frequency $F_2$ can be ten times or more greater than the first frequency $F_2$, $F_2 \geq 10*F_1$. The second frequency $F_2$ can be 10 to 1000 times greater than the first frequency $F_1$. Alternating current sources 104*a-b* can provide alternating current at the desired frequencies.

In one embodiment, the resonant frequency of the first output circuit 102*c* can be between about 1 megahertz to about 500 megahertz and the resonant frequency of the second output circuit 102*d* can be between about 10 kilohertz to about 1 megahertz. In another embodiment, the resonant frequency of the second output circuit 102*d* can be between about 1 megahertz to about 500 megahertz and the resonant frequency of the first output circuit 102*c* can be between about 10 kilohertz to about 1 megahertz.

The first output circuit 102*c* can further comprise a first output circuit capacitor 105*c*, having a first output capacitance $C_{o1}$, in parallel with the first output winding 103*c*. The first output winding 103*c* can have a first output inductance $L_{o1}$. The second output circuit 102*d* can further comprise a second output circuit capacitor 105*d*, having a second output capacitance $C_{o2}$, in parallel with the second output winding 103*d*. The second output winding 103*d* can have a second output inductance $L_{o2}$. In order to minimize inducement of current in the second output circuit 102*d* from the first input circuit 102*a*, and to minimize inducement of current in the first output circuit 102*c* from the second input circuit 102*b*, an inverse square root of the product of the first output capacitance $C_{01}$ and the first output inductance $L_{01}$ does not equal an inverse square root of the product of the second output capacitance $C_{02}$ and the second output inductance $L_{02}$, $$\frac{1}{\sqrt{C_{01} * L_{01}}} \neq \frac{1}{\sqrt{C_{02} * L_{02}}}.$$

The first frequency $F_1$ can equal the inverse of the product of two times π times the square root of the first output inductance $L_{o1}$ times the first output capacitance $C_{o1}$, $$F_1 = \frac{1}{2 * \pi * \sqrt{L_{01} * C_{01}}}.$$

The second frequency $F_2$ can equal the inverse of the product of two times π times the square root of the second output inductance $L_{o2}$ times the second output capacitance $C_{o2}$, $$F_2 = \frac{1}{2 * \pi * \sqrt{L_{02} * C_{02}}}.$$

The first output circuit 102*c* can supply power to a load 106. The second output circuit can supply power to a high voltage generator 107. High DC voltage potential from the high voltage generator 107 can supply high DC voltage potential to the alternating current signal at the load 106 on the first output circuit 102*c*. A resistor 108 can be used in the connection between the high voltage generator 107 and the first output circuit 102*c*. In this and other embodiments, the high voltage generator 107 can be a Cockcroft-Walton multiplier 80 as shown in FIG. 8.

Figure 11:
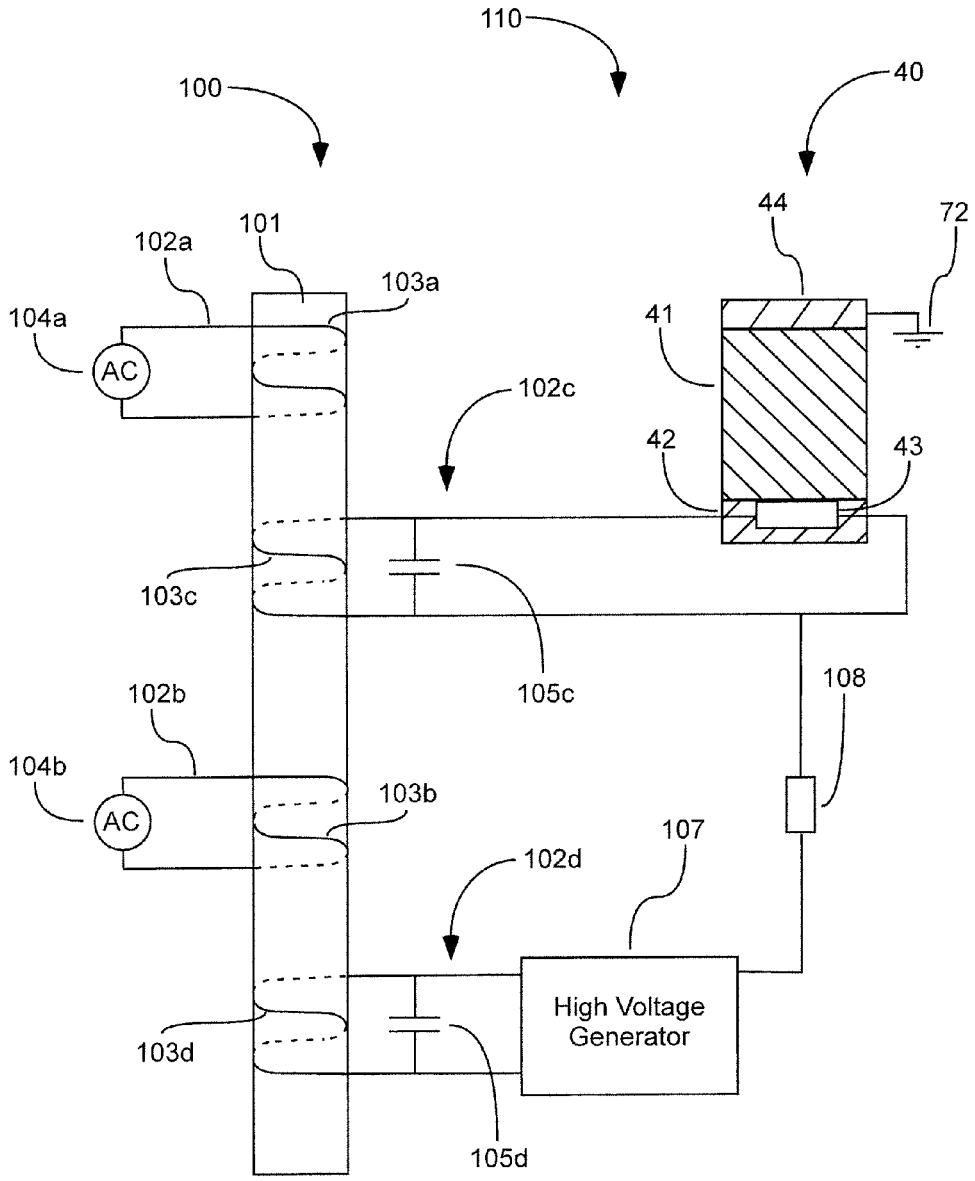
FIG. 11 is a schematic cross-sectional side view of a multiple channel transformer in which two circuits utilize the same transformer core, one of these circuits is used to supply power to an x-ray tube electron emitter and the other is used to supply power to a high voltage generator.

The various embodiments of the multiple channel transformer 100 described previously can be used in an x-ray source 110, as illustrated in FIG. 11. The x-ray source 110 can comprise a multiple channel transformer 100 and an x-ray tube 40. The x-ray tube 40 can comprise an insulative cylinder 41, an anode 44 disposed at one end of the insulative cylinder 41, and a cathode 42 disposed at an opposing end of the insulative cylinder 41 from the anode 44. The cathode 42 can include an electron emitter 43, such as a filament.

The first output circuit 102*c* can provide an alternating current signal to the electron emitter 43. The second output circuit 102*d* can provide alternating current to a high voltage generator 107. The high voltage generator 107 can generate a high DC voltage potential. The high DC voltage potential can be connected to the first output circuit 102*c*, thus providing a very high DC bias to the filament while also providing an alternating current through the electron emitter 43. The anode 44 can be connected to ground 72.

A voltage differential of at least 10 kilovolts can exist between the anode 44 and the cathode 42. Due to this large voltage differential between the anode 44 and the cathode 42, and due to heat from the alternating current through the electron emitter 43, electrons can be emitted from the electron emitter 43 and propelled towards the anode 44.

High Voltage Sensing Resistor

Figure 12:
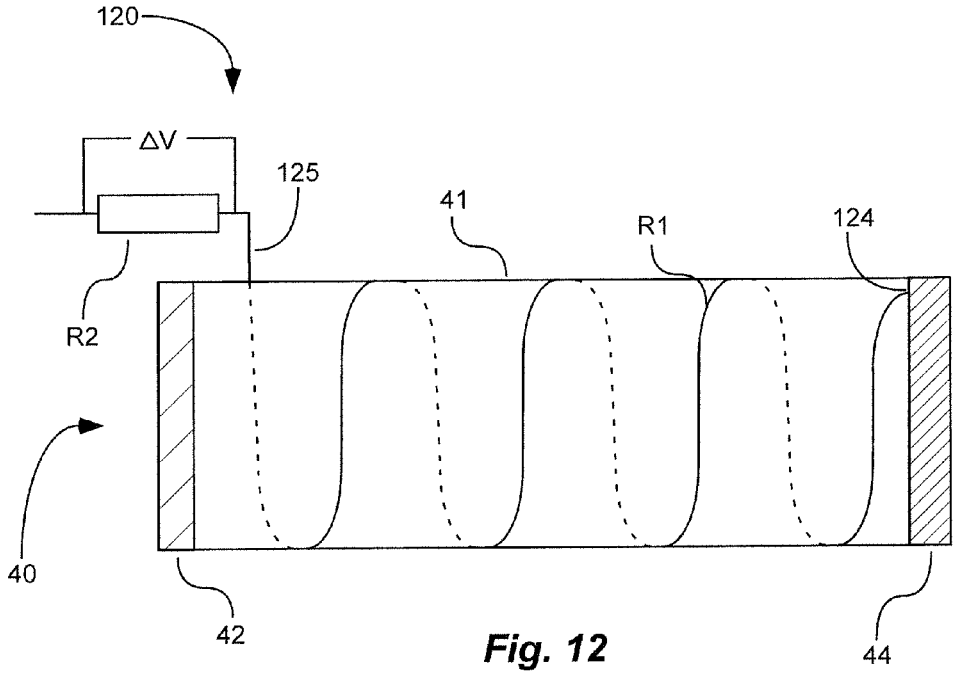
FIG. 12 is a schematic cross-sectional side view of an x-ray tube cylinder with multiple wraps of a first resistor, used as a high voltage sensing resistor, in accordance with an embodiment of the present invention.
Figure 13:
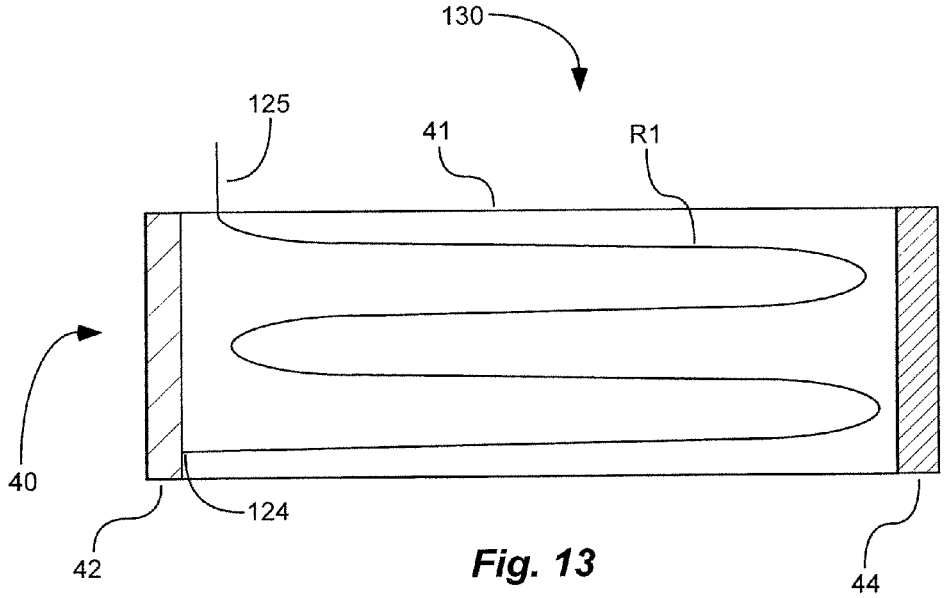
FIG. 13 is a schematic cross-sectional side view of an x-ray tube cylinder and a first resistor disposed on the cylinder in a zig-zag shaped pattern, used as a high voltage sensing resistor, in accordance with an embodiment of the present invention.

As illustrated in FIG. 12, an x-ray source 120 is shown comprising an x-ray tube 40 and a line of insulative material, comprising a first resistor R1. The x-ray tube 40 comprises an insulative cylinder 41, an anode 44 disposed at one end of the insulative cylinder 41, and a cathode 42 disposed at an opposing end of the insulative cylinder 41 from the anode 44. The first resistor R1 has a first end 124 which is attached to either the anode 44 or the cathode 42, and a second end 125 which is configured to be connected to an external circuit. In FIG. 12, the first end 124 of the first resistor R1 is shown attached to the anode 44. In FIG. 13, the first end 124 of the first resistor R1 is shown attached to the cathode 42. In all embodiments herein, the first end 124 of the first resistor R1 may be attached to either the cathode 42 or to the anode 44.

A resistance r1 across the first resistor R1 from one end to the other end can be very large. In one embodiment, a resistance r1 across the first resistor R1 from one end to the other end can be at least about 10 mega ohms. In another embodiment, a resistance r1 across the first resistor R1 from one end to the other end can be at least about 1 giga ohm. In another embodiment, a resistance r1 across the first resistor R1 from one end to the other end can be at least about 10 giga ohms. In another embodiment, a resistance r1 across the first resistor R1 from one end to the other end can be at least about 100 giga ohms.

As illustrated in FIG. 12, the first resistor R1 can wrap around a circumference of the insulative cylinder 41, such as about four times shown in FIG. 12. In one embodiment, the first resistor R1 can wrap around a circumference of the insulative cylinder 41 at least one time. In another embodiment, the first resistor R1 can wrap around a circumference of the insulative cylinder 41 at least twenty-five times.

The first resistor R1 can be any electrically insulative material that will provide the high resistance required for high voltage applications. In one embodiment, the first resistor R1 is a dielectric ink painted on a surface of the insulative cylinder 41. MicroPen Technologies of Honeoye Falls, N.Y. has a technology for applying a thin line of insulative material on the surface of a cylindrical object. An insulative cylinder 41 of an x-ray tube 40 can be turned on a lathe-like tool and the insulative material is painted in a line on the exterior of the insulative cylinder 41.

As shown in FIG. 12, the second end 125 of the first resistor R1 can be attached to a second resistor R2, such that the two resistors R1 and R2 are connected in series. Voltage ΔV can be measured across the second resistor R2 by a voltage measurement device connected across the second resistor R2. Voltage V across the x-ray tube 40 can then be calculated by the formula $$V = \frac{V_2 * (r_1 + r_2)}{r_2},$$

wherein V is a voltage across the x-ray tube 40, V2 is a voltage across the second resistor R2, r1 is a resistance of the first resistor R1, and r2 is a resistance of the second resistor R2.

The second resistor R2 can have a lower resistance r2 than the first resistor R1. In one embodiment, the second resistor R2 can have a resistance r2 of at least 1 kilo ohm less than a resistance r1 of the first resistor R1. In another embodiment, the second resistor R2 can have a resistance r2 of at least 1 mega ohm less than a resistance r1 of the first resistor R1. In one embodiment, the second resistor R2 can have a resistance r2 of less than about 1 mega ohm. In another embodiment, the second resistor R2 can have a resistance r2 of less than about 1 kilo ohm. In another embodiment, the second resistor R2 can have a resistance r2 of less than about 100 ohms.

The first resistor R1 need not wrap around the cylinder but can be disposed in any desired shape on the cylinder, as long as the needed resistance from one end to another is achieved. For example, as shown on x-ray source 130 in FIG. 13, the first resistor R1 is disposed in a zig-zag like pattern on the insulative cylinder 41.

Figure 14:
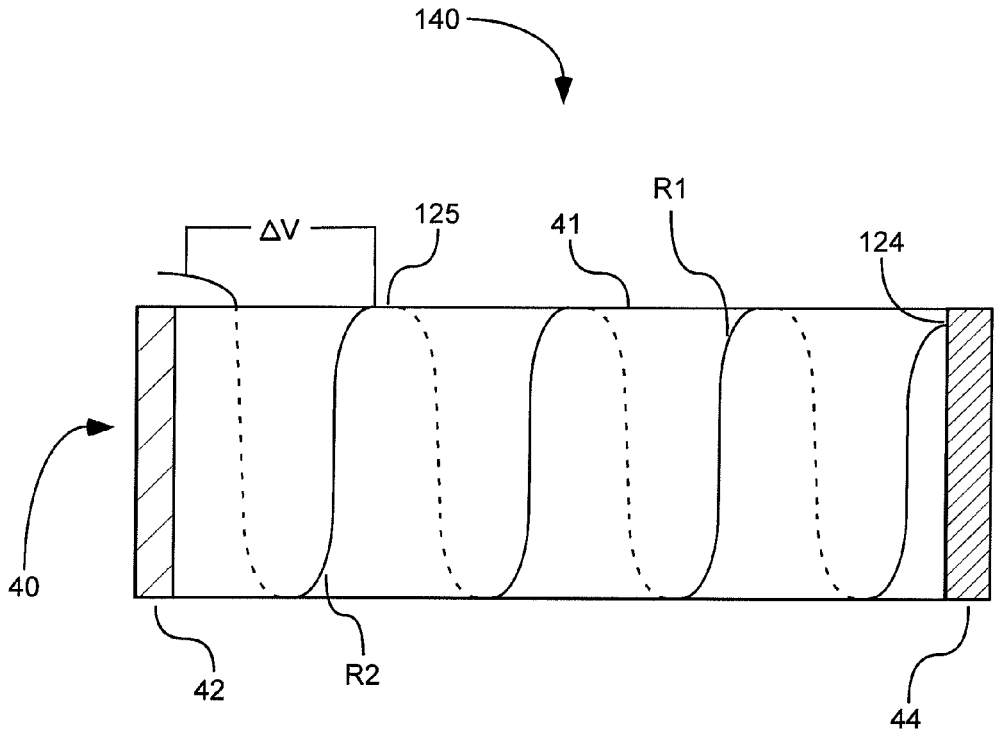
FIG. 14 is a schematic cross-sectional side view of an x-ray tube cylinder with multiple wraps of a first resistor, used as a high voltage sensing resistor, and a second resistor across which voltage drop is measured, in accordance with an embodiment of the present invention.

As shown on x-ray source 140 in FIG. 14, the second resistor R2, like the first resistor R1, can be disposed on the insulative cylinder 41. In one embodiment, the second resistor R2 can wrap around the insulative cylinder 41 at least one time. In another embodiment, the second resistor R2 can be disposed on the insulative cylinder 41 in a zig-zag like pattern or any other pattern. The second resistor R2 can be a dielectric ink painted on a surface of the insulative cylinder 41.

In one embodiment, the first resistor R1 and/or the second resistor R2 can comprise beryllium oxide (BeO), also known as beryllia. Beryllium oxide can be beneficial due to its high thermal conductivity, thus providing a more uniform temperature gradient across the resistor.

The second resistor R2 can be connected to ground or any reference voltage at one end and to the first resistor R1 at an opposing end.

A method for sensing voltage across an x-ray tube 40 can comprise:

a) painting insulative material on a surface of an insulative cylinder 41, the insulative material comprising a first resistor R1;

b) connecting the first resistor R1 to a second resistor R2 at one end 125 and to either a cathode 42 or an anode 44 of the insulative cylinder 41 at an opposing end 124; and c) measuring a voltage ΔV across the second resistor R2; and d) calculating a voltage V across the x-ray tube 40 by $$V = \frac{V_2 * (r_1 + r_2)}{r_2},$$

wherein V is a voltage across the x-ray tube 40, V2 is a voltage across the second resistor, r1 is a resistance of the first resistor, and r2 is a resistance of the second resistor.

U.S. patent application Ser. No. 12/890,325, filed on Sep. 24, 2010 (now U.S. Pat. No. 8,526,574), and U.S. Provisional Patent Application Ser. No. 61/420,401, filed on Dec. 7, 2010, are hereby incorporated herein by reference in their entirety.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A power source comprising:

a. a first alternating current source connected in series with a first capacitor;

b. the first alternating current source configured to be operated at a first frequency and a first amplitude;

c. a second alternating current source configured to be operated at a second frequency and a second amplitude;

d. the first alternating current source and the first capacitor connected in parallel with the second alternating current source;

e. the first frequency having a value that is at least 3 times greater than the second frequency;

f. the second amplitude having a value that is at least 3 times greater than the first amplitude;

g. a high voltage generator having two connection points at a low voltage end and two connection points at a high voltage end;

h. the first alternating current source and the first capacitor and the second alternating current source connected in parallel with the two connection points at the low voltage end of the high voltage generator; and i. a load connected between the two connection points at the high voltage end of the high voltage generator.

2. The power source of claim 1, wherein the load comprises an x-ray tube filament and a second capacitor connected in series.

3. The power source of claim 1, wherein the first frequency has a value of greater than 100 megahertz and the second frequency has a value of between 10 kilohertz to 10 megahertz.

4. The power source of claim 1, wherein the first amplitude has a value of less than 10 volts and the second amplitude has a value of greater than 100 volts.

5. The power source of claim 1, wherein:

a. the high voltage generator is a Cockcroft-Walton multiplier with diodes that have a forward voltage of greater than 10 volts; and b. the first amplitude has a value of less than 10 volts.

6. The power source of claim 1, wherein the high voltage generator develops a voltage differential between the low voltage end and the high voltage end of greater than 10 kilovolts.

7. The power source of claim 1, further comprising:

a. an x-ray tube comprising:

i. an insulative cylinder;

ii. an anode disposed at one end of the insulative cylinder and electrically connected to ground;

iii. a cathode at an opposing end of the insulative cylinder from the anode, the cathode comprising a filament;

b. the filament is the load;

c. the first alternating current source drives alternating current and power at the filament;

d. the second alternating current source supplies alternating current to the high voltage generator, allowing the high voltage generator to develop a voltage differential from the low voltage end to the high voltage end of greater than 10 kilovolts, thus creating a high voltage at the cathode and a voltage differential between the cathode and the anode; and e. the voltage differential between the cathode and the anode and the alternating current at the filament cause electrons to be emitted from the filament and propelled towards the anode.

8. The power source of claim 1, wherein the second alternating current source comprises:

a. an alternating current source connected in series with input windings on a step-up transformer;

b. output windings on the step-up transformer connected in parallel with the first alternating current source and the first capacitor.

9. An x-ray source comprising:

a. a power source comprising:

i. a first alternating current source connected in series with a first capacitor;

ii. the first alternating current source configured to be operated at a first frequency and a first amplitude;

iii. a second alternating current source configured to be operated at a second frequency and a second amplitude;

iv. the first alternating current source and the first capacitor connected in parallel with the second alternating current source;

v. the first frequency having a value that is at least 3 times greater than the second frequency;

vi. the second amplitude having a value that is at least 3 times greater than the first amplitude;

vii. a high voltage generator having two connection points at a low voltage end and two connection points at a high voltage end;

viii. the first alternating current source and the first capacitor and the second alternating current source connected at the two connection points at the low voltage end of the high voltage generator and in parallel with the high voltage generator; and ix. a load connected between the two connection points of the high voltage end of the high voltage generator and in parallel with the high voltage generator;

b. an x-ray tube comprising:

i. an insulative cylinder;

ii. an anode disposed at one end of the insulative cylinder and electrically connected to ground; and iii. a cathode at an opposing end of the insulative cylinder from the anode, the cathode comprising a filament;

c. the load comprises the filament and a second capacitor connected in series;

d. the first alternating current source drives alternating current and power at the filament;

e. the second alternating current source supplies alternating current to the high voltage generator, allowing the high voltage generator to develop a voltage differential from the low voltage end to the high voltage end, thus creating a voltage differential between the cathode and the anode; and f. the voltage differential between the cathode and the anode and the alternating current at the filament cause electrons to be emitted from the filament and propelled towards the anode.

10. The x-ray source of claim 9, wherein:

a. the first frequency has a value of greater than 100 megahertz and the second frequency has a value of between 10 kilohertz to 10 megahertz;

b. the first amplitude has a value of less than 10 volts and the second amplitude has a value of greater than 100 volts;

c. the high voltage generator is a Cockcroft-Walton multiplier with diodes that have a forward voltage of greater than 10 volts.

11. A multiple channel transformer comprising:

a. a transformer core;

b. a first input circuit wrapped at least one time around the transformer core and configured to carry an alternating current signal at a first frequency;

c. a first output circuit comprising a first output winding;

d. the first output winding wrapped at least one time around the transformer core;

e. the first output circuit having a resonant frequency which is about the same as the first frequency;

f. a second input circuit wrapped at least one time around the transformer core and configured to carry an alternating current signal at a second frequency;

g. a second output circuit comprising a second output winding;

h. the second output winding wrapped at least one time around the transformer core; and i. the second output circuit having a resonant frequency which is about the same as the second frequency.

12. The multiple channel transformer of claim 11, further comprising:

a. a first output circuit capacitor, having a first output capacitance, in parallel with the first output winding, the first output winding having a first output inductance, and the first frequency equals the inverse of the product of two times $\pi$ times the square root of the first output inductance times the first output capacitance; and b. a second output circuit capacitor, having a second output capacitance, in parallel with the second output winding, the second output winding having a second output inductance, and the second frequency equals the inverse of the product of two times $\pi$ times the square root of the second output inductance times the second output capacitance.

13. The multiple channel transformer of claim 11, wherein the first frequency is at least ten times greater than the second frequency.

14. The multiple channel transformer of claim 11, wherein the second frequency is at least ten times greater than the first frequency.

15. The multiple channel transformer of claim 11, wherein the first frequency is between 10 times greater to 1000 times greater than the second frequency.

16. The multiple channel transformer of claim 11, wherein:

a. the first input circuit induces a current in the first output circuit at the first frequency with negligible inducement of current in the first output circuit from the second input circuit; and b. the second input circuit induces a current in the second output circuit at the second frequency with negligible inducement of current in the second output circuit from the first input circuit.

17. The multiple channel transformer of claim 11, wherein:

a. the first output circuit further comprises a first output circuit capacitor, having a first output capacitance, in parallel with the first output winding;

b. the first output winding having a first output inductance;

c. the second output circuit further comprises a second output circuit capacitor, having a second output capacitance, in parallel with the second output winding;

d. the second output winding having a second output inductance; and e. an inverse square root of the product of the first output capacitance and the first output inductance does not equal an inverse square root of the product of the second output capacitance and the second output inductance.

18. The multiple channel transformer of claim 11, wherein the inverse square root of the product of the first output capacitance and the first output inductance is greater than ten times the inverse square root of the product of the second output capacitance and the second output inductance.

19. The multiple channel transformer of claim 11, wherein:

a. the resonant frequency of the first output circuit is between 1 megahertz to 500 megahertz; and b. the resonant frequency of the second output circuit is between 10 kilohertz to 1 megahertz.

20. The multiple channel transformer of claim 11, further comprising:

a. an x-ray tube comprising:

i. an insulative cylinder;

ii. an anode disposed at one end of the insulative cylinder and electrically connected to ground;

iii. a cathode disposed at an opposing end of the insulative cylinder from the anode, the cathode comprising a filament;

b. a high voltage generator for generating a high voltage having an absolute value of at least 10 kilovolts electrically connected to the cathode, the high voltage generator providing a voltage differential of at least 10 kilovolts between the anode and the cathode;

c. the first output circuit electrically connected to and providing an alternating current to the filament;

d. the second output circuit electrically connected to and providing an alternating current to the high voltage generator.

* * * * *